US010515750B2

(12) United States Patent
Jeong

(10) Patent No.: US 10,515,750 B2
(45) Date of Patent: Dec. 24, 2019

(54) COIL ELECTRONIC COMPONENT WITH DISTANCE BETWEEN LEAD PORTION AND COIL PATTERN GREATER THAN DISTANCE BETWEEN ADJACENT COIL PATTERNS

(71) Applicant: SAMSUNG ELECTRO-MECHANICS CO., LTD., Suwon-si, Gyeonggi-do (KR)

(72) Inventor: Dong Jin Jeong, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/082,539

(22) Filed: Mar. 28, 2016

(65) Prior Publication Data

US 2016/0351319 A1 Dec. 1, 2016

(30) Foreign Application Priority Data

May 29, 2015 (KR) ..... 10-2015-0075952

(51) Int. Cl.
*H01F 17/00* (2006.01)
*H01F 27/29* (2006.01)

(52) U.S. Cl.
CPC ..... *H01F 17/0013* (2013.01)

(58) Field of Classification Search
CPC ..... H01F 27/29; H01F 2017/0073; H01F 17/0013
USPC ..... 336/192
See application file for complete search history.

(56) References Cited

U.S. PATENT DOCUMENTS 6,137,389 A * 10/2000 Uchikoba ..... H01F 17/06 333/185
2003/0098496 A1* 5/2003 Sugiyama ..... H01F 17/0006 257/531
2005/0181684 A1* 8/2005 Ito ..... H05K 3/3442 439/894

(Continued)

FOREIGN PATENT DOCUMENTS

JP 11-087139 A 3/1999
JP 11087139 A * 3/1999 ..... H01F 17/00

(Continued)

OTHER PUBLICATIONS

JP2010287722A, Machine Translation, Dec. 2010.*

(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil electronic component includes a substrate; a coil pattern formed on at least one of first and second main surfaces of the substrate; a body region filling at least a core region of the coil pattern and having a magnetic material; and a lead portion forming a portion of an outermost region of the coil pattern and exposed to the outside of the body region. A distance between the lead portion and a portion of the coil pattern which is immediately adjacent to the lead portion and which is disposed between the lead portion and a center of the coil pattern is larger than a distance between adjacent patterns of the coil pattern.

20 Claims, 4 Drawing Sheets

(56) References Cited

U.S. PATENT DOCUMENTS

2012/0119863 A1* 5/2012 Wu ..... H01F 17/0013 336/192
2013/0027171 A1* 1/2013 Ito ..... H01F 17/0013 336/200
2013/0249662 A1* 9/2013 Tonoyama ..... H01F 27/255 336/200
2013/0265131 A1* 10/2013 Yang ..... H01F 27/29 336/192
2014/0225699 A1* 8/2014 Sekiguchi ..... H01F 27/2804 336/192
2014/0266547 A1* 9/2014 Watanabe ..... H01F 17/0013 336/200
2014/0292466 A1* 10/2014 Watanabe ..... H01F 27/29 336/192
2015/0035639 A1* 2/2015 Nakamura ..... H01F 17/0013 336/200
2015/0123757 A1 5/2015 Choi
2016/0111195 A1* 4/2016 Nishyama ..... H01F 17/0013 336/200
2016/0163451 A1* 6/2016 Wang ..... H01F 41/042 336/192

FOREIGN PATENT DOCUMENTS

JP 2001-102217 A 4/2001
JP 2001102217 A * 4/2001 ..... H01F 17/00
JP 2008078226 A * 4/2008 ..... H01F 17/00
JP 2010-287722 A 12/2010
JP 2010287722 A * 12/2010 ..... H01F 17/00
JP 2012248629 A * 12/2012 ..... H01F 17/00
KR 20030043645 A 6/2003
KR 10-1474166 B1 12/2014

OTHER PUBLICATIONS

JP2001102217A, Machine Translation, Apr. 2001.*
Korean Office Action issued in Korean Patent Application No. 10-2015-0075952, dated Jun. 16, 2017, with English Translation.

* cited by examiner

COIL ELECTRONIC COMPONENT WITH DISTANCE BETWEEN LEAD PORTION AND COIL PATTERN GREATER THAN DISTANCE BETWEEN ADJACENT COIL PATTERNS

CROSS-REFERENCE TO RELATED APPLICATION

This application claims benefit of priority to Korean Patent Application No. 10-2015-0075952 filed on May 29, 2015, with the Korean Intellectual Property Office, the disclosure of which is incorporated herein by reference.

TECHNICAL FIELD

The present disclosure relates to a coil electronic component.

BACKGROUND

An inductor corresponding to a coil electronic component is a representative passive element configuring an electronic circuit together with a resistor and a capacitor to remove noise.

The inductor may be classified into a multilayer type inductor, a thin film type inductor, and the like. Among them, the thin film type inductor is appropriate for being relatively thinly manufactured. Therefore, the thin film type inductor has recently been utilized in various fields, and an attempt to further decrease thickness of a component has been continuously conducted in accordance with the trend toward complexation, multi-functionalization, and slimness of set components. Accordingly, a scheme capable of securing high performance and reliability in spite of the trend toward the slimness of the coil electronic component in the related art has been demanded.

SUMMARY

An aspect of the present disclosure may provide a coil electronic component capable of having improved reliability and having high current and high inductance by appropriately adjusting a distance between a coil pattern and a lead portion included in the coil electronic component to significantly decrease a possibility of short circuits between the coil pattern and the lead portion.

According to an aspect of the present disclosure, a coil electronic component may include: a substrate; a coil pattern formed on at least one of first and second main surfaces of the substrate; a body region filling at least a core region of the coil pattern and having a magnetic material; and a lead portion forming a portion of an outermost region of the coil pattern and exposed to the outside of the body region. A distance between the lead portion and a portion of the coil pattern which is immediately adjacent to the lead portion and which is disposed between the lead portion and a center of the coil pattern is larger than a distance between adjacent patterns of the coil pattern.

As described above, the distance between the outermost portion of the coil pattern and the lead portion may be larger than a pitch of the coil pattern, that is, the distance between the adjacent patterns, whereby the possibility of short circuits between the coil pattern and the lead portion due to excessive growth at the time of performing a process such as a plating process, or the like, may be decreased.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
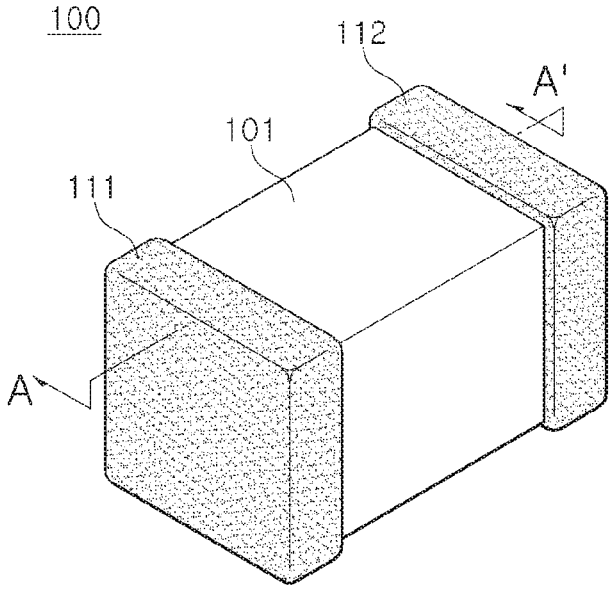
FIG. 1 is a perspective view schematically illustrating an appearance of a coil electronic component according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Coil Electronic Component

Hereinafter, a coil electronic component according to an exemplary embodiment, particularly, a thin film type inductor will be described by way of example. However, the coil electronic component according to an exemplary embodiment is not necessarily limited thereto.

Figure 2:
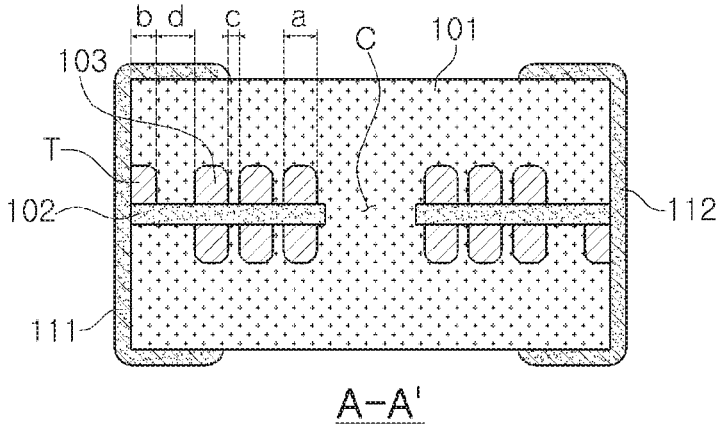
FIG. 2 is a cross-sectional view taken along line A-A' of FIG. 1.
Figure 3:
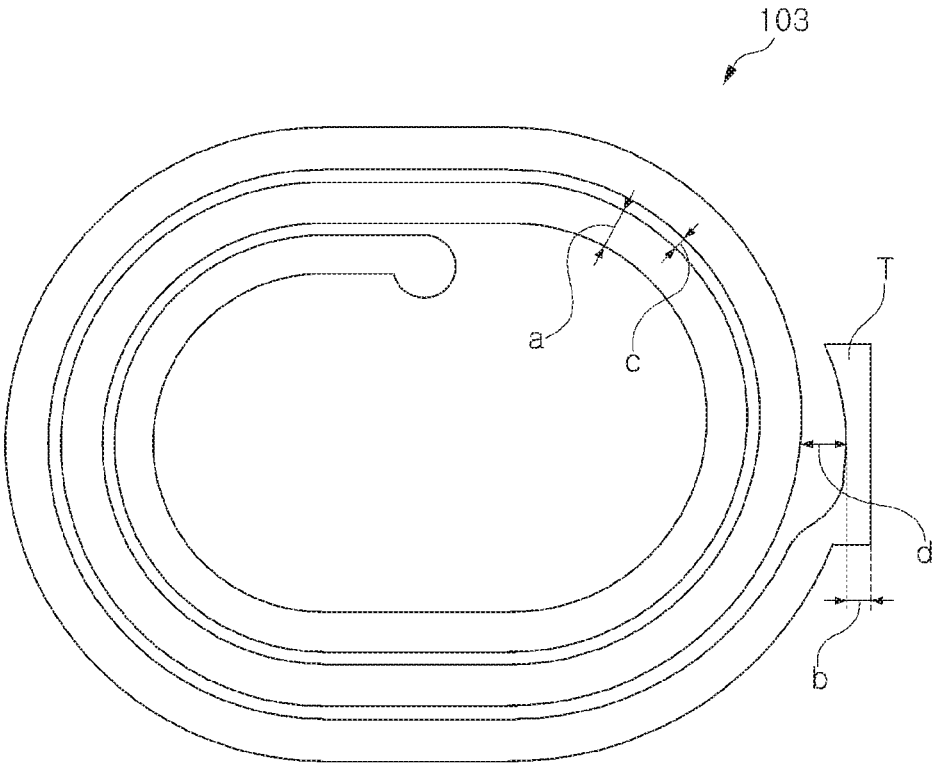
FIGS. 3 and 4 are plan views illustrating a coil pattern and a lead portion according to exemplary embodiments in the present disclosure.
Figure 4:
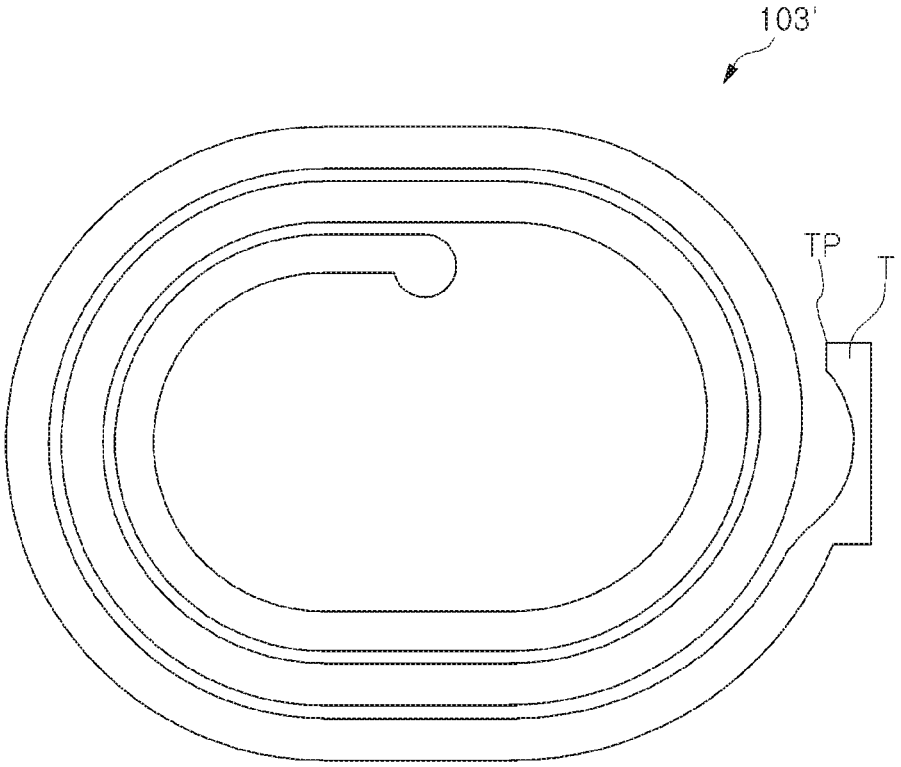
Figure 5:
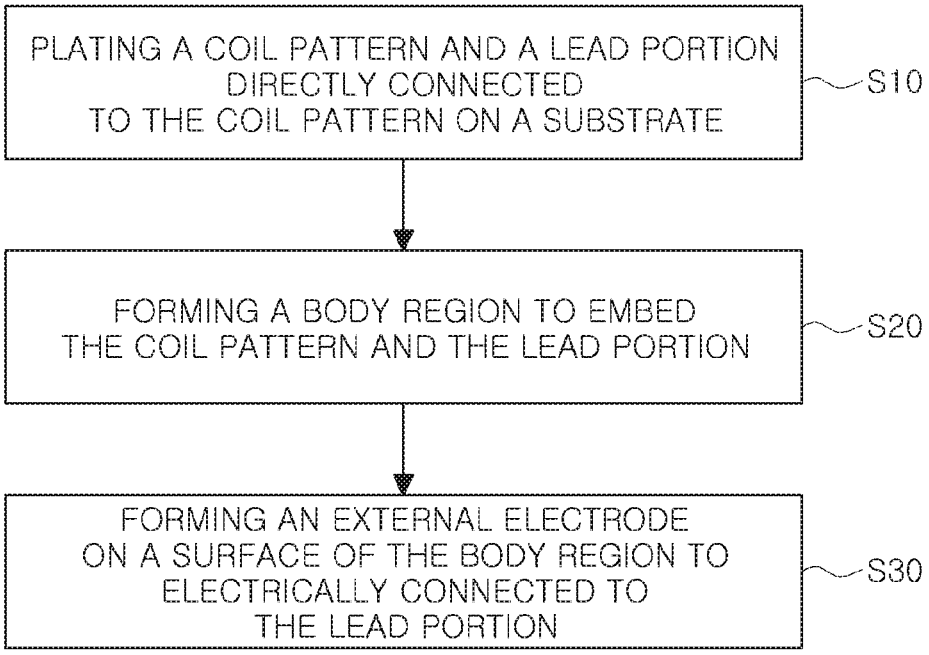
FIG. 5 is a flow chart illustrating a method of manufacturing a coil electronic component according to an exemplary embodiment in the present disclosure.

FIG. 1 is a perspective view schematically illustrating an appearance of a coil electronic component according to an exemplary embodiment. In addition, FIG. 2 is a cross-sectional view taken along line A-A' of FIG. 1, and FIGS. 3 and 4 are plan views illustrating a coil pattern and a lead portion according to exemplary embodiments in the present disclosure.

Referring to FIGS. 1 through 4, a coil electronic component 100 according to an exemplary embodiment may include a substrate 102, a coil pattern 103, a body region 101, and external electrodes 111 and 112.

The substrate 102 may be disposed in the body region 101 to serve to support the coil pattern 103, and may be, for example, a polypropylene glycol (PPG) substrate, a ferrite substrate, a metal based soft magnetic substrate, or the like. In this case, a through-hole may be formed in a central region of the substrate 102, and a magnetic material may be provided in the through-hole to form a core region C. The core region C may configure a portion of the body region 101. As described above, the core region C in which the magnetic material is provided may improve performance of the coil electronic component 100.

The coil pattern 103 may be formed on at least one of first and second main surfaces of the substrate 102. In the present exemplary embodiment, the coil patterns 103 are formed on both of the first and second main surfaces of the substrate 102 in order to obtain high inductance. That is, a first coil pattern may be formed on the first main surface of the substrate 102, and a second coil pattern may be formed on the second main surface of the substrate 102 opposing the first main surface of the substrate 102. In this case, the first and second coil patterns may be electrically connected to a via (not illustrated) penetrating through the substrate 102. In addition, the coil pattern 103 may have a spiral shape, and the outermost portion of the coil pattern having the spiral shape may be provided with a lead portion T exposed to the outside of the body region 101 for the purpose of electrical connection to the external electrodes 111 and 112. The lead portion T may form a portion of the outermost region of the coil pattern 103 and may be formed integrally with the coil pattern 103. Although not shown, the coil patterns 103 may be formed on only one of the first and second main surfaces of the substrate 102 according to another embodiment.

The coil pattern 103 may be formed of a metal having high electrical conductivity, such as silver (Ag), palladium (Pd), aluminum (Al), nickel (Ni), titanium (Ti), gold (Au), copper (Cu), platinum (Pt), or alloys thereof. In this case, as an example of a preferable process for manufacturing a thin film shape, an electroplating method may be used. Alternatively, other processes known in the related art may also be used as long as an effect similar to an effect of the electroplating method may be accomplished.

In the present exemplary embodiment, referring to FIGS. 2 through 4, a distance d between the lead portion T and the portion of the coil pattern 103 which is immediately adjacent to the lead portion T and which is disposed between the lead portion T and the center of the coil pattern 103 may be larger than a pitch of the coil pattern 103, that is, a distance c between adjacent patterns. The coil pattern 103 may be formed in the spiral shape in order to serve as an inductor. The lead portion T formed integrally with the coil pattern 103 may be generally spaced apart from the coil pattern 103 at the same distance as that between the adjacent patterns. However, in order to implement the coil electronic component 100 at a small size and increase inductance of the coil electronic component 100, a width of the coil pattern needs to be wide, and the distance c between the coil patterns needs to be narrow. Therefore, the possibility that a short circuit will be generated between the adjacent coil patterns 103 or between the coil pattern 103 and the lead portion T may be increased. Particularly, the lead portion T externally exposed may have an area larger than that of the coil pattern 103 positioned in the body region 101, and thus a problem due to excessive growth may occur at the time of performing the subsequent plating process.

Therefore, in the present exemplary embodiment, a shape of the lead portion T may be changed as compared with the related art, thereby increasing the distance between the coil pattern 103 and the lead portion T. As an example of this form, as illustrated in FIGS. 3 and 4, a surface toward the coil pattern 103 or 103' in the lead portion T may be formed as a curved surface, and a radius of curvature of the curved surface may be different from that of the coil pattern 103 or 103'. In a case in which the radius of curvature of the curved surface is smaller than that of the coil pattern 103 or 103', a large distance d of the lead portion d may be more easily secured. Referring to FIG. 3, the entire surface of the lead portion T toward the coil pattern 103 is curved. Alternatively, referring to FIG. 4, a distal portion TP of the lead portion T has a flat surface facing the coil pattern 103' and the rest portion of the lead portion T has a curved surface facing the coil pattern 103'.

In addition, the distance d of the lead portion T may also be appropriately determined in a relationship with the distance c between the adjacent patterns. In detail, when the distance between the adjacent patterns of the coil pattern 103 is c and the distance between the outermost portion of the coil pattern 103 and the lead portion T is d, a condition of $1.5c<d$ may be satisfied. In a case in which d is larger than 1.5c, reliability may be improved and high inductance may be implemented due to prevention of short circuits, which is intended by the present inventor.

In addition, a width b of the narrowest portion of lead portion T may be appropriately determined in a relationship with the width a of the coil pattern 103. In detail, when the width of the coil pattern 103 is a and the width of the narrowest portion of the lead portion T is b, a condition of $2a/3<b$ may be satisfied. In order to dispose the lead portion T at a position more distant from the coil pattern 103 within a limited region, a method of forming the lead portion T at a relatively narrow width may be used. Even in this case, since electrical performance of the lead portion T connected to the external electrodes 111 and 112 should not be significantly deteriorated, the width b of the narrowest portion of the lead portion T may be about ⅔ of the width a of the coil pattern 103.

Meanwhile, as described above, the lead portion T may be obtained by a method of forming the lead portion at a large width as in the related art and then removing a portion of the lead portion, or the like. The curved surface of the lead portion T may be formed as a gentle form (a form in which a radius of curvature is large) as illustrated in FIG. 3, or may be formed as a form having a large inclination (a form in which a radius of curvature is small) as illustrated in FIG. 4, depending on desired performance, a design condition, and the like.

The body region 101 may have a form in which at least the core region C of the coil pattern 103 is filled with the magnetic material, or the like, and may form an appearance of the coil electronic component 100 as in the present exemplary embodiment. In this case, the body region 101 may be formed of any material that shows a magnetic property, and may be formed of, for example, ferrite or metal magnetic particles in a resin part.

As a specific example of these materials, the ferrite may be a material such as an Mn—Zn based ferrite, an Ni—Zn based ferrite, an Ni—Zn—Cu based ferrite, an Mn—Mg based ferrite, a Ba based ferrite, an Li based ferrite, or the like, and the body region 101 may have a form in which the ferrite particles are dispersed in a resin such as epoxy, polyimide, or the like.

In addition, the metal magnetic particle may contain one or more selected from the group consisting of Fe, Si, Cr, Al, and Ni. For example, the metal magnetic particle may be a Fe—Si—B—Cr based amorphous metal, but is not necessarily limited thereto. The metal magnetic particles may have a diameter of about 0.1 μm to 30 μm, and the body region 101 may have a form in which the metal magnetic particles are dispersed in a resin such as epoxy, polyimide, or the like, similar to the ferrite particles described above.

Method of Manufacturing Coil Electronic Component

Hereinafter, an example of a method of manufacturing the coil electronic component 100 having the structure described above will be described. Referring to FIGS. 1 through 4, and FIG. 5 which illustrates a method of manufacturing the coil electronic component 100, first, the coil pattern 103 may be formed on the substrate 102 (S10). Here, the coil pattern 103 may be formed using, preferably, a plating process, but is not limited thereto. As described above, the coil pattern 103 may have a spiral shape, and the lead portion T exposed to the outside of the body region 101 for the purpose of electrical connection to the external electrodes 111 and 112 may be formed at the outermost portion of the coil pattern so as to be connected to the coil pattern (S10).

In this case, as described above, the distance d between the lead portion T and the portion of the coil pattern 103 which is immediately adjacent to the lead portion T and which is disposed between the lead portion T and the center of the coil pattern 103 may be larger than the pitch of the coil pattern 103, that is, the distance c between the adjacent patterns. To this end, a portion of the lead portion T may be appropriately removed. That is, after the lead portion T is formed to be spaced apart from the coil pattern 103 at the same distance as the pitch of the coil pattern 103, a partial region of the lead portion T may be removed to increase the distance d of the lead portion T. Alternatively, the lead portion T having a desired shape may be formed and patterned in a plating process without separately removing the lead portion T.

Meanwhile, although not separately illustrated, an insulating layer coating the coil pattern 103 may be formed in order to protect the coil pattern 103. The insulating layer may be formed by a known method such as a screen printing method, an exposure and development method of a photoresist (PR), a spray applying method, or the like.

Next, as an example of forming the body region 101, magnetic sheets may be stacked on and beneath the substrate 102 on which the coil pattern 103 is formed, compressed, and then hardened (S20). The magnetic sheets may be manufactured in a sheet shape by mixing metal magnetic powder and organic materials such as a binder, a solvent, and the like, with each other to prepare a slurry, applying the slurry at a thickness of several tens of micrometers onto carrier films by a doctor blade method, and then drying the applied slurry.

The through-hole for the core region C may be formed in the central region of the substrate 102 using a method such as mechanical drilling, laser drilling, sand blasting, punching, or the like. The through-hole may be filled with the magnetic material at the time of stacking, compressing, and hardening the magnetic sheets to form the core region C.

Next, first and second external electrodes 111 and 112 may be formed on surfaces of the body region 101 so as to be each connected to the lead portions T exposed to both surfaces of the body region 101 (S30). The external electrodes 111 and 112 may be formed of a paste containing a metal having excellent electrical conductivity, such as a conductive paste containing nickel (Ni), copper (Cu), tin (Sn), or silver (Ag), or alloys thereof. In addition, plating layers (not illustrated) may be further formed on the external electrodes 111 and 112. In this case, the plating layers may contain one or more selected from the group consisting of nickel (Ni), copper (Cu), and tin (Sn). For example, nickel (Ni) layers and tin (Sn) layers may be sequentially formed in the plating layers.

A description of features overlapping those of the coil electronic component according to the exemplary embodiment described above except for the above-mentioned description will be omitted.

As set forth above, according to an exemplary embodiment, the distance between the coil pattern and the lead portion included of the coil electronic component may be appropriately adjusted to significantly decrease the possibility of short circuits between the coil pattern and the lead portion, whereby reliability of the coil electronic component may be improved and high current and high inductance of the electronic component may be implemented.

While exemplary embodiments have been shown and described above, it will be apparent to those skilled in the art that modifications and variations could be made without departing from the scope of the present invention as defined by the appended claims.

What is claimed is:

1. A coil electronic component comprising:

a substrate;

a coil pattern having a spiral shape and formed on at least one of first and second main surfaces of the substrate;

a body region filling at least a core region of the coil pattern and having a magnetic material; and a lead portion, as a portion of an outermost region of the coil pattern, exposed from a surface of the body region, wherein a distance d between the lead portion, and a portion of the coil pattern which is immediately adjacent to the lead portion, which is disposed between the lead portion and a center of the coil pattern, and which has a curved surface facing the lead portion, is larger than a distance c between adjacent patterns of the coil pattern, wherein the distance c between adjacent patterns of the coil pattern is uniform, wherein a surface of the lead portion facing the portion of the coil pattern, immediately adjacent to the lead portion, is a curved surface, wherein an outermost distance is a distance between a portion of the coil pattern physically connected to the lead portion and another portion of the coil pattern immediately adjacent to the portion of the coil pattern physically connected to the lead portion, and wherein a greatest distance of the outermost distance is smaller than the distance d.

2. The coil electronic component of claim 1, wherein a radius of curvature of the curved surface of the lead portion is different from that of the coil pattern.

3. The coil electronic component of claim 2, wherein the radius of curvature of the curved surface of the lead portion is smaller than that of the coil pattern.

4. The coil electronic component of claim 1, wherein a width a of the coil pattern and a width b of a narrowest portion of the lead portion satisfy $2a/3<b$.

5. The coil electronic component of claim 1, wherein the distances c and d satisfy $1.5c<d$.

6. The coil electronic component of claim 1, wherein the coil pattern is formed by plating.

7. The coil electronic component of claim 1, wherein the coil pattern includes first and second coil patterns disposed on the first and second main surfaces of the substrate, respectively.

8. The coil electronic component of claim 1, further comprising an external electrode disposed on the surface of the body region and connected to the lead portion.

9. The coil electronic component of claim 1, wherein the body region contains metal magnetic powder and a thermosetting resin.

10. The coil electronic component of claim 1, wherein an entire surface of the lead portion facing the coil pattern is curved.

11. A coil electronic component comprising:

a substrate;

a coil pattern formed on at least one of first and second main surfaces of the substrate;

a body region filling at least a core region of the coil pattern and having a magnetic material; and an external electrode disposed on a surface of the body region, wherein a lead portion, as a portion of an outermost region of the coil pattern, has an outer surface exposed from the surface of the body region and is in direct contact with the external electrode, wherein an inner surface of the lead portion opposing the outer surface that is in direct contact with the external electrode includes a curved surface, wherein the coil pattern includes a portion directly extending from the lead portion and having a curved surface extending from the inner surface of the lead portion, wherein a distance c between patterns of the coil pattern other than the lead portion and an inner end portion of the coil pattern is uniform and is less than a distance d between the lead portion and a portion of the coil pattern which is immediately adjacent to the lead portion and which faces the lead portion, wherein an outermost distance is a distance between a portion of the coil pattern physically connected to the lead portion and another portion of the coil pattern immediately adjacent to the portion of the coil pattern physically connected to the lead portion, and wherein a greatest distance of the outermost distance is smaller than the distance d.

12. The coil electronic component of claim 11, wherein the distances c and d satisfy $1.5c<d$.

13. The coil electronic component of claim 11, wherein a width a of the coil pattern and a width b of a narrowest portion of the lead portion satisfy $2a/3<b$.

14. The coil electronic component of claim 11, wherein the entire inner surface of the lead portion facing the coil pattern is curved.

15. The coil electronic component of claim 11, wherein the lead portion includes a distal portion having a flat surface facing the coil pattern.

16. A coil electronic component comprising:

a substrate;

a coil pattern having a spiral shape and formed on at least one of first and second main surfaces of the substrate;

a body region filling at least a core region of the coil pattern and having a magnetic material; and a lead portion, as a portion of an outermost region of the coil pattern, exposed from a surface of the body region, wherein a distance d between the lead portion, and a portion of the coil pattern which is immediately adjacent to the lead portion, which is disposed between the lead portion and a center of the coil pattern, and which has a curved surface facing the lead portion, is larger than a distance c between adjacent patterns of the coil pattern, wherein a surface of the lead portion facing the portion of the coil pattern, immediately adjacent to the lead portion, is a curved surface, wherein the lead portion includes first and second end portions and a central portion between the first and second end portions, wherein in plan view, a width of the central portion is less than a width of the first end portion and a width of the second end portion, wherein a first distance from the central portion to the portion of the coil pattern which is immediately adjacent to the lead portion is greater than a second distance from the first end portion to the portion of the coil pattern which is immediately adjacent to the lead portion, and wherein the first distance is greater than a third distance from the second end portion to the portion of the coil pattern which is immediately adjacent to the lead portion.

17. The coil electronic component of claim 16, wherein the distance c between adjacent patterns of the coil pattern is uniform.

18. The coil electronic component of claim 16, wherein a radius of curvature of the curved surface of the lead portion is smaller than that of the coil pattern.

19. The coil electronic component of claim 16, wherein a width a of the coil pattern and a width b of a narrowest portion of the lead portion satisfy $2a/3<b$.

20. The coil electronic component of claim 16, wherein the distances c and d satisfy $1.5c<d$.

* * * * *